United States Patent [19]

Chrisley

[11] Patent Number: 4,747,432

[45] Date of Patent: May 31, 1988

[54] FLEXIBLE WIRE CLAMPING TOOL AND KIT

[76] Inventor: Barney D. Chrisley, P.O. Box 280, Ingleside, Tex. 78362

[21] Appl. No.: 936,644

[22] Filed: Nov. 26, 1986

[51] Int. Cl.[4] ..... B21F 9/02

[52] U.S. Cl. ..... 140/102.5; 81/9.3; 140/123.5

[58] Field of Search ..... 81/9.3; 140/117, 123, 140/123.5, 102.5, 106

[56] References Cited

U.S. PATENT DOCUMENTS

| | | | |
|---|---|---|---|
| 784,114 | 3/1905 | Moock . | |
| 902,804 | 11/1908 | Coghlan | 81/9.3 |
| 1,078,533 | 11/1913 | Beaudette . | |
| 1,393,988 | 10/1921 | Wirt | 81/9.3 |
| 1,553,110 | 9/1925 | Rich . | |
| 1,666,491 | 4/1928 | Evans | 81/9.3 |
| 2,494,963 | 1/1950 | Ray | 81/9.3 |
| 2,600,394 | 6/1952 | Conklin . | |
| 2,623,424 | 12/1952 | Ackerman . | |
| 2,681,580 | 6/1954 | Dupkas . | |
| 3,865,155 | 2/1975 | Spath . | |
| 4,084,625 | 4/1978 | Brinegar . | |
| 4,306,592 | 12/1981 | Drage . | |

FOREIGN PATENT DOCUMENTS

| | | | |
|---|---|---|---|
| 127352 | 4/1948 | Australia | 81/9.3 |
| 102427 | 12/1916 | United Kingdom | 81/9.3 |

*Primary Examiner*—Lowell A. Larson

*Attorney, Agent, or Firm*—Lowe, Price, LeBlanc, Becker & Shur

[57] ABSTRACT

A tool for forming a wire clamp includes an elongate member having projections extending transversely from one end thereof, the end including a groove receiving a portion of a wire defining a straight crossover portion extending between circular portions formed respectively by wrapping the wire around the projections. A tool for clamping or banding the preformed wire over a hose or other item to be clamped comprises a stationary block shaped part pivotally secured to a movable part at one end thereof. A threaded puller extends through the stationary part and one end thereof contacts the movable block intermediate the pivot and an opposite end containing a groove receiving the wire crossover portion. Opposite end portions of the wire are wrapped around a pair of posts, respectively, on the stationary block. Rotation of the threaded puller via a wing nut integrally formed at the upper end thereof separates the movable and stationary blocks from each other about the pivot to tighten the circular portions into clamping contact with the hose or other item. A kit comprising the aforesaid tools, including hose barb connectors and wire is also disclosed.

13 Claims, 2 Drawing Sheets

FLEXIBLE WIRE CLAMPING TOOL AND KIT

TECHNICAL FIELD

The present invention relates generally to an improved wire bending tool and, more particularly, to a wire clamping tool and a wire forming tool for shaping a wire to be placed around an end of a hose or other object to be clampled thereagainst.

BACKGROUND ART

Wire banding tools are known for forming a wire band or clamp 10 as shown in FIG. 1 from a length of steel wire wherein the wire is manually bent into the form of an elongated "U" with circular wire portions 12 spaced from each other and connected together by a crossover wire portion 14. Thus, it is readily apparent that the circular wire portions and crossover wire portion are formed from a single length of steel wire and are therefore integral with each other. An end of a hose or other object to be clamped is inserted within the circular wire portions and a wire banding tool clamps the wire against the object by "pulling" opposite ends of the wire to decrease the diameters of and thereby tighten the circular portions.

U.S. Pat. No. 4,084,625 discloses a wire banding tool comprising an elongated tubular body formed from a length of commercially available steel tubing, the body having longitudinal slots on opposite sides thereof through which transversely extends a roll pin received in a bore of a threaded rod extending through the body. A wing nut is screwed to one end of the rod passing out of the rearward end of the body. The forward end of the body has grooves receiving the wire crossover portion with ends of the wire wrapped around ends of the roll pin. By tightening the wing nut to draw the rod rearwardly, the circular portions are tightened on the hose to achieve a desired clamping fit. The tool is then rotated about the hose through an angle about 180° to form bent retaining portions which are secured to the wire crossover portion. The excess lengths of the wire ends are then cut off to complete the clamp.

While the foregoing clamping tool is generally effective, there are numerous disadvantages rendering it either difficult or impossible to use in certain environments. For example, since the tubular body must be rotated through about 180° and is an elongate member, a large working diameter (e.g., 14–16 inches or twice the length of the tubular body) is necessary to lock the wire clamp in place. Therefore, this prior art clamping tool may be difficult to use, for example, within the confines of an automobile engine compartment where space is at a premium.

Another disadvantage of the prior art banding tool relates to the relationship of the thread pitch of a threaded rod relative to its adjustment of the circumference of the circular wire portions. In other words, the circular wire portions are tightened (i.e., their circumferences are reduced) only by a distance corresponding to the thread pitch for each 360° rotation of the wing nut. Thus, considerable time is often required to complete the wire band by sufficient tightening particularly when forming larger size wire clamps. A commensurate amount of effort is also required.

Another disadvantage of the prior art banding tool is that the wing nut bears against the upper end surface of the tubular body generating considerable friction resisting clamping rotational movement of the wing nut and which may prevent complete and proper tightening, resulting in an inferior clamp.

Still another disadvantage of the prior art banding tool is that it is formed from metal and is therefore relatively heavy.

It is often difficult for the user to initially form the wire into a shape approximating the clamp, i.e., one having parallel spaced circular portions and a crossover portion.

DISCLOSURE OF INVENTION

It is accordingly one object of the present invention to provide an improved wire banding tool requiring only a small working diameter in which to form a wire band or clamp.

Another object is to provide a wire banding tool having a clamp tightening ratio greater than unity, i.e., the clamp tightening ratio defined herein being such that for each 360° rotation of the threaded rod in the wire banding tool, the circular wire portion circumferences are reduced by an amount greater than the thread pitch.

Another object is to provide a wire banding tool having small bearing surfaces between the threaded rod and that part of the banding tool which is moved to reduce the circular wire portion circumferences, thereby achieving low frictional movement for greater tightening action.

Another object is to provide a wire banding tool formed of lightweight materials, such as plastic, and that is of durable construction.

Still a further object of the invention is to provide a forming tool that will facilitate initial formation of the wire into a wire clamp configuration for subsequent clamping with the wire banding tool of the invention.

Yet another object is to provide a portable kit containing the forming tool and wire banding tool for home, commercial, industrial and field use.

A wire clamping tool, in accordance with the present invention, comprises a tool body having first and second parts connected to each other, the first part including wire attaching means for securing opposite ends of the wire forming the clamp to the first part, the second part extending between the wire clamp and the first part and being formed with means for retaining a portion of the wire clamp located between the wire ends against the second part. A threaded puller is threadedly secured in the first part. Rotation of the puller causes movement of the second part in relation to the first part to increase the distance between the attaching means and the wire retaining means to thereby tighten the wire clamp.

The first part is preferably a stationary part and the second part is preferably a movable part. The wire clamp includes a pair of spaced, generally parallel circular portions connected by a generally straight cross portion. The circular portions are formed by an intermediate portion of the wire forming the clamp with the opposite wire ends respectively forming a part of the circular portion. The wire retaining means thus includes a groove receiving the cross portion and the wire attaching means includes a pair of posts around which the opposite ends of the wire are wrapped, respectively, for tightening of the circular portions.

In accordance with one feature of the invention, the stationary part and movable part are pivotally connected to each other with the groove formed at one end of the movable part with the pivot at the opposite end of said part. The threaded puller has one end acting against the movable part intermediate the pivot and groove, whereby advancement of the puller a distance D as a result of 360° of rotation of the puller thereby causes the end of the movable part containing the groove to move through a distance D1, wherein D1>D.

The stationary part is generally block shaped and the movable part is elongate block shaped with the groove formed in the underside of the movable part block. The pivot is defined by a pin passing through the movable block and the stationary part.

The posts respectively include slots receiving opposite ends of the wire to securely retain the wire ends to the stationary part.

In accordance with another feature of the invention, the threaded puller is preferably in the form of a bolt with a wing nut integrally formed at an upper end thereof. The wing nut is spaced from the stationary part. Thus, the only bearing part between the threaded puller and the movable part is the end of the puller in contact with the movable part. This arrangement results in low friction movement by virtue of minimizing the bearing surfaces between the threaded parts. The pivotal movement of the movable part relative to the stationary part also contributes to low friction movement between the parts allowing the manual force exerted to rotate the threaded puller to be converted substantially entirely into a clamp tightening force without appreciable frictional resistance.

In accordance with another feature of the invention, the movable and stationary parts are preferably plastic and the threaded puller is metallic resulting in a lightweight yet rugged band forming tool.

In accordance with yet another feature of the invention, a forming tool is also disclosed. The forming tool may be used to form a length of wire into a wire clamp having a pair of spaced wire circular portions connected by a generally straight crossover portion extending between the circular portions and generally perpendicular to the planes of said circular portions. The circular portions are each formed from an end portion of the wire located intermediate the crossover portion and one associated end of the wire. The forming tool comprises an elongate member having a pair of projections extending outwardly therefrom. The projections are collinear with each other.

The projections are preferably formed at one end of the elongate member and that one end is formed with a groove adapted to receive a piece of the wire forming the crossover portion. The elongate member and the projections may be molded as one part, preferably of plastic material.

The present invention also contemplates a kit comprising the forming tool and the wire clamping tool as discussed above. The kit may further include one or more hose barb connectors and wire for forming the wire clamp.

These and further objects and advantages of the present invention will become more apparent upon reference to the following specification, appended claims and drawings herein.

BEST MODE FOR CARRYING OUT THE INVENTION

Figure 1:
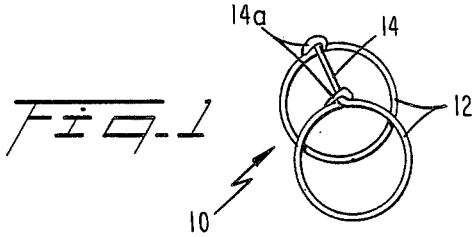
FIG. 1 is a perspective view of a wire clamp formed with the forming tool and wire banding tool of the present invention.
Figure 2:
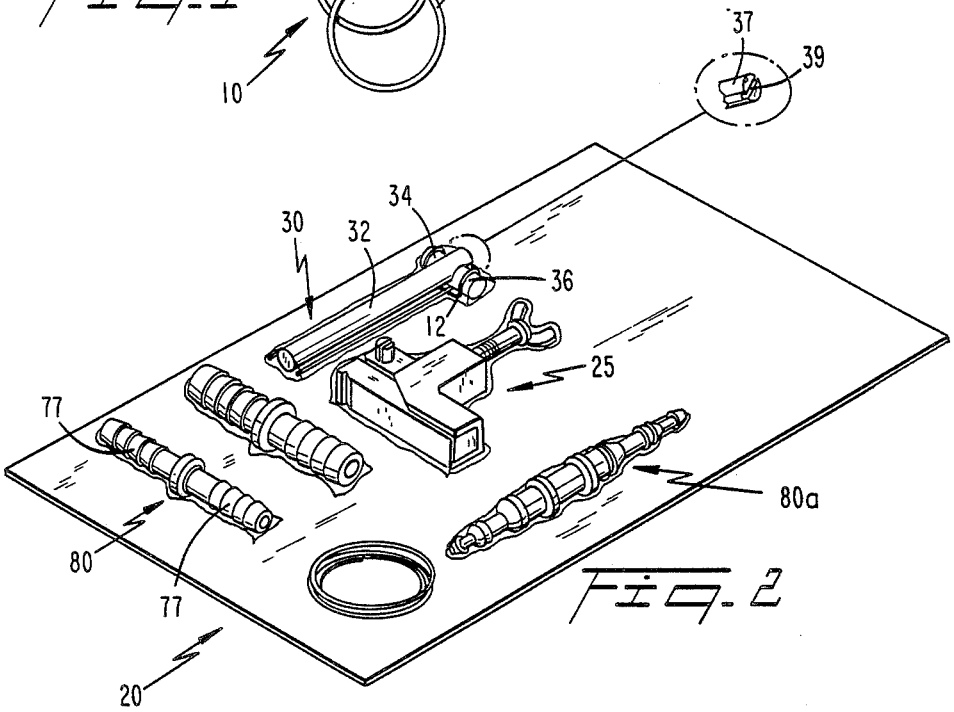
FIG. 2 is a perspective view of the clamping or banding tool and a forming tool and other kit components in accordance with the present invention.
Figure 3:
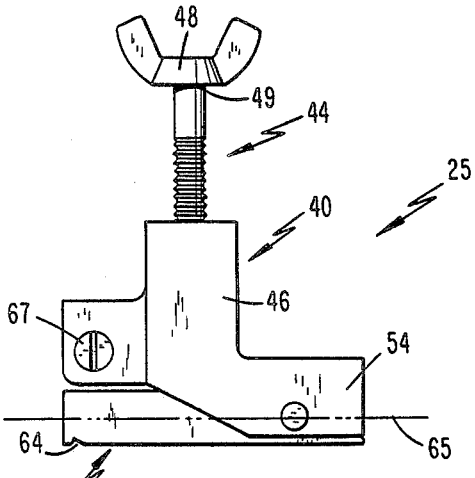
FIG. 3 is a side elevational view of the clamping tool of the invention.
Figure 4A:
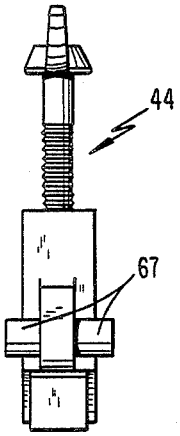
FIG. 4A is an end elevational view of the clamping tool of the invention.
Figure 4B:
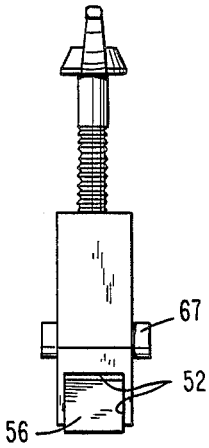
FIG. 4B is the opposite end view of the clamping tool.
Figure 6A:
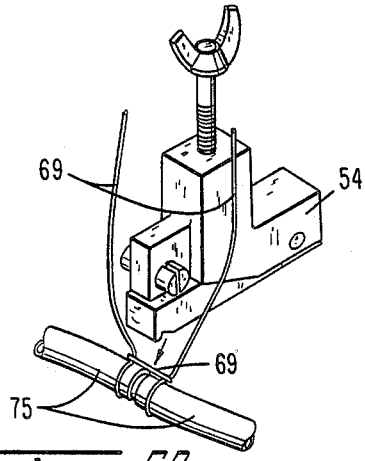
FIGS. 6A, 6B, 6C and 6D are action views depicting the manner in which the wire banding tool of the invention is used to secure a preformed wire clamp over a hose or item to be clamped to form the wire clamp of FIG. 1.

Referring now to the drawings and particularly FIG. 2 therein, there is disclosed a wire clamping kit 20 in accordance with the present invention comprising a wire band forming tool 25 serving to form a wire band or clamp 10 from a wire 12 as discussed above in connection with FIG. 1. The wire band 10 is initially preformed with a forming tool 30, the latter comprising a straight elongate portion 32 having cylindrical projections 34 and 36 projecting transversely from one end 37 of the elongate member. Preferably, the member and projections are integrally formed, for example, from molded plastic. The end containing the projections includes a groove 39 adapted to receive a portion of wire 14 defining the crossover portion. Groove 39 is preferably straight and coplanar with the coplanar longitudinal axes (formed pependicular to each other) of the elongate member and projections. The longitudinal axes of each projection 34, 36 are collinear with each other and parallel to groove 39. The manner in which wire 14 may be preformed into the shape depicted in FIG. 6A is readily apparent in light of the foregoing description of forming tool 30.

Figure 5:
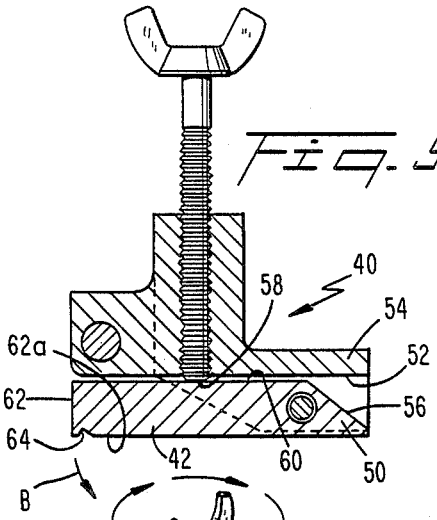
FIG. 5 is a sectional view taken along the line 5—5 of FIG. 2 to depict the relationship of the pivot and threaded puller bearing point.

The wire banding tool 25 essentially comprises three component parts in the form of a stationary part 40, a movable part 42 and a threaded puller 44 extending perpendicular through the main portion 46 of the stationary part. The threaded puller 44 is formed with a wing nut 48 at an upper end 49 thereof which is spaced from the stationary part 40. The movable part 42 is pivotally secured at one end 50 thereof to the stationary part 40, as best depicted in FIG. 5 by means of a pin passing through the parts. The pivotally secured end 50 of the movable part 42 is received within a downwardly facing channel 52 formed by a rearwardly extending end portion 54 of the stationary part. The cross-section of the channel 52 is preferably rectangular and the rear end 50 of the movable part 42 is tapered at 56 rearwardly to allow for maximum pivotal movement of the movable part.

A lower end 58 of the threaded puller 44 bears against an upper surface 60 of the movable part 42 intermediate opposite ends thereof. The forward end 62 of the movable part 42 is formed with a groove 64 in a lower surface 62*a* thereof extending transversely relative to the longitudinal axis 65 of the movable part. Vertically spaced from the end 62 of the movable part 42 containing the groove 64 are a pair of notched projections 67 around which opposite end portions 69 of the preformed wire are respectively wrapped as depicted in FIG. 6B while the crossover portion 14 is received within the groove 64.

Figure 6C:
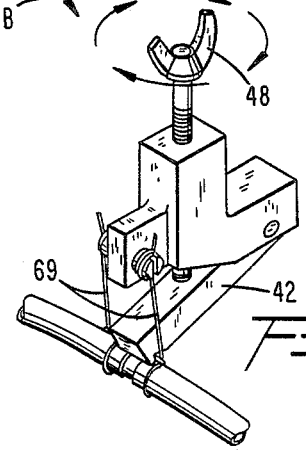
Figure 6B:
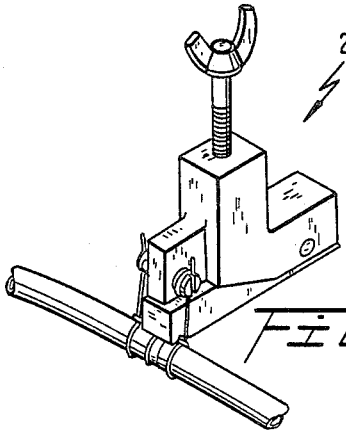

Once the wire banding tool 25 is secured in the FIG. 6B position, the wing nut 48 is then rotated as depicted in FIG. 6C causing the movable part 42 to pivot away in the direction of arrow B from the notched projections 67 causing the wire ends 69 wrapped around the projections to tighten around the hose 75 or other object to be clamped. After the wire is tightened a sufficient amount, the banding tool 25 is rotated through an angle of about 90° over the top of the crossover portion 14 to define the bent retaining portions **14*a* of FIG. 1 upon cutting off the excess lengths 69** of wire following rotation of the banding tool about the object being clamped.

Figure 6D:
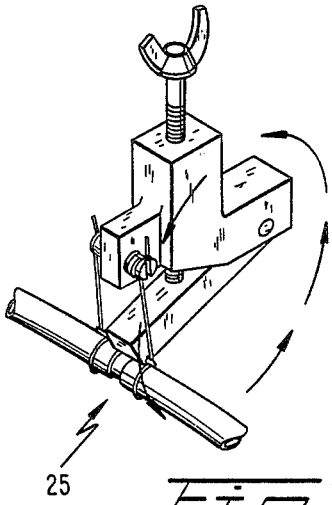

To reduce overall weight of the clamping tool, both the movable part 42 and stationary part 40 are preferably formed from synthetic material such as plastic or nylon with the threaded puller 44 being metal. From a dimensional standpoint, the overall height of the clamping tool 25 as measured from the base **62*a* of the movable part to the top of the wing nut 48 is preferably in the range of 2 to 3 inches while the length of the tool as measured between opposite ends of the movable part 42** is in the range of 1½ to 2½ inches. This type of compact structure allows the device to have a working diameter (with reference to the rotation of the tool depicted in FIG. 6D) of approximately 4 to 7 inches unlike the prior art devices discussed supra.

Referring back to FIG. 2, the kit 20 of the present invention may also include hose barb connectors 80 and **80*a* and a coiled length of wire 82. The hose barb connectors are essentially hollow cylindrical structures adapted to be inserted at opposite ends thereof into two pieces of hose 75 (FIG. 6A) to be clamped together. A series of lands or barbs 77** are formed on each end of the connector to assist in securing the connector to the hose lengths.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A wire clamping tool, comprising:

(a) tool body means having a first part and a second part connected to each other, the first part including wire attaching means for securing opposite ends of a wire forming clamp to the first part, the second part extending between the wire clamp and the first part and being formed with means for retaining a portion of the wire clamp located between the wire ends against the second part; and (b) a threaded puller threadedly secured in the first part, rotation of said puller causing movement of the second part in relation to the first part to increase the distance between the attaching means and the wire retaining means to thereby tighten the wire clamp, said first part being an L-shaped member in side elevational view having a first portion extending generally perpendicular to the second part and receiving said puller along the longitudinal axis of the first portion, said L-shaped member having a second portion generally perpendicular to the first portion and to which second portion the second part is pivotally secured, said first and second portion defining a gripping space in which the user's hand can be accommodated in gripping contact with said first and second portions.

2. The tool of claim 1, wherein said wire clamp includes a pair of spaced, generally parallel circular portions connected by a generally straight cross portion, the circular portions being formed by intermediate portions of the wire forming the clamp with said opposite wire ends respectively forming a part of the circular portion, and wherein said wire retaining means includes a groove receiving the crossover portion and said wire attaching means includes a pair of posts projecting forwardly from the first portion and around which said opposite ends are wrapped, respectively, for tightening of the circular portions.

3. The tool of claim 2, wherein said first part is a stationary part and the second part is a movable part pivotally connected to each other with the groove formed at one end of the movable part and with the pivot at the opposite end of the movable part, the threaded puller having one end acting against the movable part intermediate the pivot and the groove, advancement of the threaded puller a distance D as a result of 360° of rotation thereby causing the end of the movable part containing the groove to move through a distance D1, wherein D1>D.

4. The tool of claim 3, wherein said stationary part is generally L block shaped and the movable part is elongate block shaped with the groove formed in an underside of the movable block.

5. The tool of claim 4, wherein said pivot is defined by a pin passing through the movable block and the stationary part.

6. The tool of claim 2, wherein said posts respectively include slots formed in ends thereof for receiving said opposite ends of the wire.

7. The tool of claim 6, wherein said threaded puller is a bolt with a wing nut integrally formed at an upper end thereof.

8. The tool of claim 7, wherein said wing nut is integral with the threaded puller and is spaced from the stationary part by the threaded puller, whereby the only bearing part between the threaded puller and the movable part is the end of the puller in contact with said movable part.

9. The tool of claim 8, wherein said movable and stationary parts are plastic and the threaded puller is metal.

10. The banding tool of claim 1, wherein said movable part and stationary part are configured to establish a forming tool having a working diameter of about 4 to 7 inches.

11. A tool for forming a length of wire into a wire clamp having a pair of spaced circular wire portions connected by a generally straight crossover portion extending between the circular portions and generally perpendicular to the planes of the circular portions, said circular portions each being formed from an end portion of the wire located intermediate the crossover portion and one associated end of the wire, said forming tool comprising an elongate member having a pair of projections extending outwardly from one end of the member, said projections being in substantially coaxial alignment with each other, said one end being further formed with a groove in the end face thereof adapted to receive a piece of said wire forming the crossover portion.

12. The forming tool of claim 11, wherein said groove is generally straight.

13. The forming tool of claim 11, wherein said member and projections are molded as one part.

* * * * *